US009796943B2

(12) United States Patent
Kim

(10) Patent No.: US 9,796,943 B2
(45) Date of Patent: Oct. 24, 2017

(54) LITHIUM-BASED THICKENER AND GREASE COMPOSITION INCLUDING THE SAME

(71) Applicant: Hyundai Motor Company, Seoul (KR)

(72) Inventor: Jae Hyeon Kim, Geoje-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/990,061

(22) Filed: Jan. 7, 2016

(65) Prior Publication Data

US 2017/0066992 A1 Mar. 9, 2017

(30) Foreign Application Priority Data

Sep. 9, 2015 (KR) ..... 10-2015-0127544

(51) Int. Cl.

| | |
|---|---|
| ***C10M 169/02*** | (2006.01) |
| ***C10M 105/04*** | (2006.01) |
| ***C10M 117/06*** | (2006.01) |
| ***C10M 145/12*** | (2006.01) |
| ***C10M 143/10*** | (2006.01) |
| ***C10M 169/04*** | (2006.01) |

(52) U.S. Cl.

CPC ..... *C10M 169/02* (2013.01); *C10M 105/04* (2013.01); *C10M 117/06* (2013.01); *C10M 143/10* (2013.01); *C10M 145/12* (2013.01); *C10M 169/044* (2013.01)

(58) Field of Classification Search

CPC C10M 169/02; C10M 105/04; C10M 117/06; C10M 145/12; C10M 143/10; C10M 169/044

See application file for complete search history.

(56) References Cited

U.S. PATENT DOCUMENTS

| | | | | |
|---|---|---|---|---|
| 2,980,614 | A * | 4/1961 | Borg | C10M 117/04 508/519 |
| 4,172,123 | A * | 10/1979 | Lowicki | A61K 8/27 424/47 |
| 2009/0159835 | A1 | 6/2009 | Kramer et al. | |

FOREIGN PATENT DOCUMENTS

| | | | |
|---|---|---|---|
| JP | 2008-286400 | | 11/2008 |
| KR | 1019950003371 | A | 2/1995 |
| KR | 10-1993-0004445 | | 4/1998 |
| KR | 10-2005-0039293 | | 9/2005 |
| KR | 1020060088951 | A | 8/2006 |
| KR | 10-0969797 | | 7/2010 |
| KR | 10-2012-0049385 | | 3/2012 |
| KR | 1020130038357 | A | 4/2013 |
| KR | 10-2014-0054557 | | 5/2014 |
| KR | 10-2014-0056920 | | 9/2014 |

* cited by examiner

*Primary Examiner* — Cephia D Toomer

(74) *Attorney, Agent, or Firm* — Brinks Gilson & Lione

(57) ABSTRACT

A lithium salt thickener that enhances thermal stability at high temperature and operability at low temperature, and a grease composition including the same, is provided.

8 Claims, No Drawings

LITHIUM-BASED THICKENER AND GREASE COMPOSITION INCLUDING THE SAME

CROSS-REFERENCE TO RELATED APPLICATION

This application claims the benefit of and priority to Korean Patent Application No. 10-2015-0127544 filed on Sep. 9, 2015, the content of which is incorporated herein by reference in its entirety.

FIELD

The present disclosure relates to lithium salt thickeners, as well as grease compositions including the same. More particularly, it relates to a lithium salt thickener that enhances thermal stability at high temperature and operability at low temperature.

BACKGROUND

The statements in this section merely provide background information related to the present disclosure and may not constitute prior art.

Grease is a semisolid-type lubricant used for lubrication of mechanical systems, such as bearings and gears, used as components in vehicles and industrial machinery. In general, grease is composed of a base oil, a thickener, and additives.

Base oil is an ingredient included to minimize viscosity change in grease according to temperature. As examples of base oil, there are ester base oil, silicon base oil, and fluorine base oil. However, application thereof is limited due to problems such as high costs, and thus, synthetic polyalphaolefin (PAO) base oil having a lower cost is mainly used.

Thickeners are ingredients determining main properties of grease such as heat resistance or water resistance. As generally used thickeners, there are metal soap-type thickeners, such as barium, lithium, calcium, sodium and aluminum soaps, as well as non-metal soap-type thickeners, such as silica gel, Bentone, and urea. Examples of the metal soap-type thickener include metal salt materials of fatty acids and, as a representative example thereof, there is lithium 12-hydroxystearate. However, a metal ingredient included in the metal soap-type thickener can function as a catalyst causing oxidation and corrosion, thereby decreasing oxidation stability and thermal stability of the grease. In addition, application thereof to a lubrication condition under high load is limited and thus properties such as wear resistance are decreased.

Since properties of grease may be greatly changed according to selected additive types, selection of a suitable additive, along with selection of a thickener, is important. A grease composition in which a lithium-based thickener is included also includes a polymer material as a viscosity regulator. Examples of such a viscosity regulator include olefin-based viscosity improvers, such as polypropylene, polyisobutylene, polyethylene-propylene, and polyethylene-butylene; olefin arylene-based viscosity improvers, such as styrene-ethylene and styrene-isoprene; polyarylene-based viscosity improvers, such as polystyrene; and a polymethacrylate-based viscosity improver. In addition, in order to enhance high-temperature endurance time, an antioxidant, an extreme pressure additive, and a corrosion inhibitor are used as additives.

Korean Patent No. 10-0513625, 10-0135414, and 10-1438916, as well as Korean Patent Laid-Open Publication No. 10-2014-0054557 describes grease compositions including additives, such as a PAO base oil, a lithium-based thickener and a viscosity regulator, as described above. However, most grease compositions have limitations in enhancing durability and maintaining operability of vehicle components in various temperature environments.

SUMMARY

The present disclosure provides a lithium-based thickener and a grease composition made therefrom, which enhances stability at high temperature and operability at low temperature.

In one aspect, the present disclosure provides a lithium-based thickener represented by Formula 1 below:

(Formula 1)

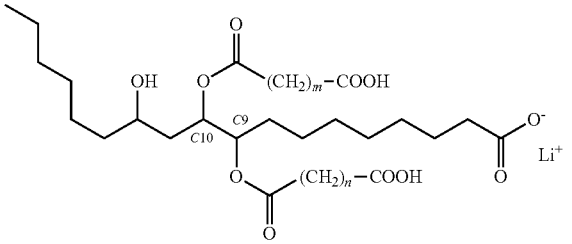

wherein m and n are the same or different and are integers of 5 to 20.

In another aspect, the present disclosure provides a grease composition comprising a) a synthetic polyalphaolefin (PAO) base oil, b) a lithium-based thickener represented by Formula 1, and optionally, c) general grease additives.

Further areas of applicability will become apparent from the description provided herein. It should be understood that the description and specific examples are intended for purposes of illustration only and are not intended to limit the scope of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features. Hereinafter reference will now be made in detail to various forms of the present disclosure, examples of which are illustrated and described below. While the present disclosure will be described in conjunction with various forms, it will be understood that present description is not intended to limit the disclosure to those forms. On the contrary, the present disclosure is intended to cover not only the various forms described, but also various alternatives, modifications, equivalents and other forms, which may be included within the spirit and scope of the disclosure as defined by the appended claims.

The present disclosure provides a lithium salt thickener which can simultaneously enhance thermal stability at high temperature and operability at low temperature, and a grease composition including the same. The lithium salt thickener according to the present disclosure may be without limitation a 9,10,12-trisubstituted stearate lithium salt represented by Formula 1 below:

(Formula 1)

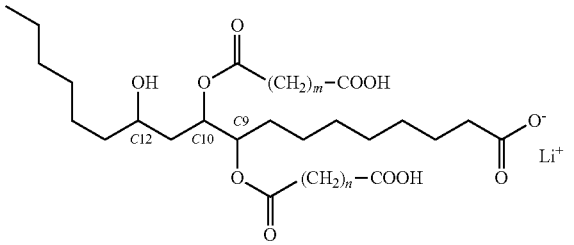

wherein m and n are the same or different and are integers of 5 to 20. In the lithium salt thickener represented by Formula 1, m and n may alternatively be the same or different and integers of 7 or 8. The lithium salt thickener is alternatively, a 9,10,12-trisubstituted stearate lithium salt.

The lithium salt thickener according to the present disclosure may be prepared through conventional organic synthesis. For example, as shown in reaction (R×n) 1 below, the 9,10,12-trisubstituted stearate lithium salt represented by Formula 1 may be prepared by esterifying 9,10,12-trihydroxystearate represented by Formula 2 and an aliphatic dicarboxylic acid represented by Formula 3 and then reacting the same with lithium hydroxide:

(Rxn1)

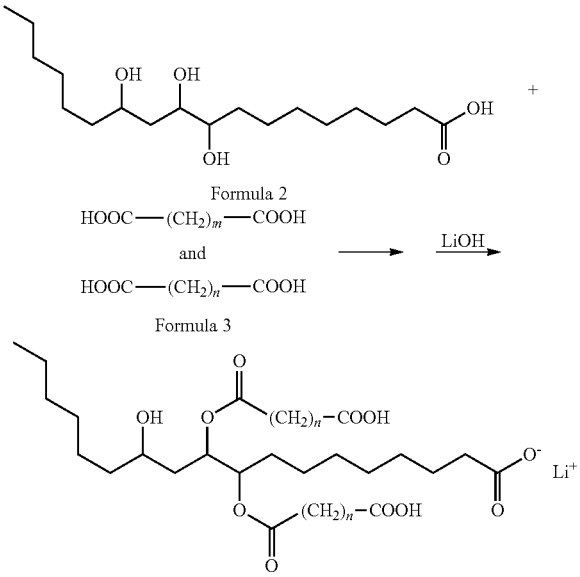

In Formulas 1 and 3 shown in R×n 1, m and n are the same or different and are integers of 5 to 20.

The thickener according to the present disclosure has a chemical structure wherein a carboxyalkyl group is additionally added to C9 and C10 sites of stearate of a conventional 12-hydroxystearate lithium salt thickener. Although not wanting to be constrained by theory, such a chemical structure, may influence the occurrence of simultaneous enhancement of low-temperature operability and high-temperature oil separation characteristics of grease.

The grease composition including the thickener represented by Formula 1 according to the present disclosure has characteristics as follows. The grease composition according to the present disclosure includes a) a synthetic polyalphaolefin (PAO) base oil; b) a lithium-based thickener represented by Formula 1; and optionally, c) general grease additives. Hereinafter, each ingredient constituting the grease composition according to the present disclosure is described in more detail.

The grease composition according to the present disclosure includes a synthetic polyalphaolefin (PAO) base oil as a base oil. The PAO synthetic base oil has a kinematic viscosity of 30 to 100 centistoke (cSt) at 40° C. and a pour point of 30° C. or less at low temperature. When the kinematic viscosity is less than 30 cSt, evaporation easily occurs and heat resistance may be deficient. When the kinematic viscosity is greater than 100 cSt, torque is high and a heating value is increased.

In the grease composition according to the present disclosure, the PAO synthetic base oil may be included in an amount of 70% to 85% by weight. Here, when the content of the base oil is less than 70% by weight, excessive consolidation occurs and thus the resultant grease is not practical. When the content of the base oil is greater than 85% by weight, excessively high oil separation degree and liquefaction at high temperature may be caused.

The grease composition according to the present disclosure includes a 9,10,12-trisubstituted stearate lithium salt represented by Formula 1 as a thickener. The thickener has a structure wherein a carboxyalkyl group is additionally added to a structure of a 12-hydroxystearate lithium salt. The high-temperature stability and low-temperature operability of grease may be simultaneously enhanced.

In the grease composition according to the present disclosure, the thickener represented by Formula 1 may be included in an amount of 10 to 20% by weight. When the content of the thickener is less than 10% by weight, desired high-temperature stability and low-temperature operability might not be simultaneously enhanced. When the thickener is used in a large amount of greater than 20% by weight, consistency of grease (NLGI) is decreased and thus low-temperature operability may be poor.

Grease may perform lubrication function without additives, but, in order to further increase performance of grease and satisfy user requirements, various additives may be included therein.

In the present disclosure, a viscosity regulator may be included as an additive. The viscosity regulator is an additive conventionally used to control a viscosity index and enhance stickiness to a base oil. General viscosity regulators have a viscosity of greater than 10,000 cSt at room temperature and thus application thereof to components in which a low-viscosity material is used is limited. Accordingly, in the present disclosure, an ester-based viscosity regulator having a viscosity of 500 to 1000 cSt at room temperature is used in an amount of 1 to 7% by weight based on the total weight of the grease composition. When the ester-based viscosity regulator is included within the range, low-temperature operability enhancement effects are achieved in addition to intrinsic effects of the viscosity regulator such as viscosity index control and enhancing stickiness to a base oil. An example of a viscosity regulator includes, but is not limited to, commercially available VL1200H, which is a hybrid olefin ester copolymer product manufactured by Lubrizol Corporation.

In addition, in the present disclosure, an oil separation regulator may be included as an additive. Grease exhibits an oil separation phenomenon wherein a base oil and a thickener may become separated during storage and thus oil ingredients are separated. Such an oil separation phenomenon may more readily occur at high temperature. Accordingly, in the present disclosure, a styrene-based copolymer as an oil separation regulator may be included in the grease composition in order to reduce oil separation even at high temperature. In particular, one or more selected from the group consisting of a styrene-ethylene/propylene block copolymer and a styrene-isoprene copolymer may be included as the oil separation regulator. The oil separation regulator may be used in an amount of 0.5 to 3% by weight based on the total weight of the grease composition. When the content of the oil separation regulator is greater than 3% by weight, the viscosity of grease is increased and thus operating feeling at low temperature and even at room temperature may be reduced.

In addition, the grease composition according to the present disclosure may include an extreme pressure additive, an antioxidant, a corrosion inhibitor, etc. as general additives. As needed, a rust inhibitor, a metal passivant, etc. may be additionally included.

The extreme pressure additive is added to enhance load carrying capacity or extreme pressure properties. When high load is added to a faying surface of a metal and thus frictional heat is increased, it is difficult to maintain lubrication function only with an oil membrane. Accordingly, the extreme pressure additive is included in the grease composition, thereby preventing wear or bake of a faying surface. In the present disclosure, the extreme pressure additive is not specifically limited and the used amount thereof may be properly controlled within a content range generally used for these additives.

The extreme pressure additive may include without limitation an organic metal-based additive, a sulfur-based additive, a phosphate-based additive, or a halogen-based additive. Several specific examples of an organic metal-based extreme pressure additive includes, but are not limited to, an organic molybdenum compound, such as molybdenum dithiocarbamate or molybdenum dithiophosphate; an organic zinc compound, such as zinc dithiocarbamate, zinc dithiophosphate or zinc pennate; an organic antimony compound, such as antimony dithiocarbamate or antimony dithiophosphate; an organic selenium compound, such as selenium dithiocarbamate; an organic bismuth compound, such as bismuth naphthenate or bismuth dithiocarbamate; an organic iron compound, such as iron dithiocarbamate and iron octylate; an organic copper compound, such as copper dithiocarbamate or copper naphthenate; an organic tin compound, such as tin maleate or dibutyl tin sulfide; an organic sulfonate, such as an alkali metal or an alkali earth metal sulfonate; an organic phosphonate, such as an alkali metal or an alkali earth metal phosphonate; or an organic metal compound, such as gold, silver, titanium and cadmium. As the sulfur-based extreme pressure additive, a sulfide, such as dibenzyl disulfide or a polysulfide compound, an oil sulfide, mineral-free carbamate, a thiourea-based compound, or a thiocarbonate may be used. As the phosphate-based extreme pressure additive, a phosphate ester, such as trioctylphosphate or tricresylphosphate; or a phosphate ester-based compound, such as acidic phosphate ester, phosphorous ester, or acidic phosphorous ester may be used. In addition, a halogen-based extreme pressure additive, such as chlorinated paraffin, may be used.

As the antioxidant, an age resister, an ozone degradation inhibitor or an antioxidant generally added to rubber, plastic, or a lubricant formulation may be used. In the present disclosure, the antioxidant is not specifically limited and a usage amount thereof may be properly controlled within a content range of generally used additives. Particular examples of the antioxidant include amine-based compounds, such as phenyl-1-naphthylamine, phenyl-2-naphthylamine, diphenyl-p-phenylenediamine, dipyridylamine, phenothiazine, N-methylphenothiazine, N-ethylphenothiazine, 3,7-dioctylphenothiazine, p,p'-dioctyldiphenylamine, N,N'-diisopropyl-p-phenylenediamine, N,N'-di-sec-butyl-p-phenylenediamine; phenolic compounds, such as 2,6-di(tert-butyl)phenol; organic metal compounds thereof; and the like.

The corrosion inhibitor also is a generally used ingredient and selection thereof is not specifically limited in the present disclosure. A usage amount thereof also may be properly controlled within a content range of generally used additives. Particular examples of such a corrosion inhibitor include ammonium salts of organic sulfonic acids; organic sulfonates or organic carbonates of alkali earth metals; hydroxy fatty acids, such as oleoyl sarcosine; mercapto fatty acids, such as 1-mercapto stearate; thiazoles; imidazoles, such as 2-(decyldithio)-benzimidazole and benzimidazole; phosphate esters, such as tris(nonylphenyl)phosphite; and thiocarboxylic esters, such as dilaurylthiopropionate. In addition, nitrite or the like may be used.

The total amount of the additives described above may be 0.1% to 10% by weight based on the total weight of the grease composition.

The following examples illustrate the teachings of the present disclosure and are not intended to limit the same.

PREPARATION EXAMPLE

Thickener Synthesis

A total of 1 mole of 9,10,12-trihydroxystearate was dissolved in 90° C. warm water, and then, azelaic acid (1.2 moles) and sebacic acid (1.2 moles) were added thereto, followed by reacting at 80° C. Subsequently, lithium hydroxide (1.2 mol) was added thereto and reacted at 60° C., thereby preparing a 9,10,12-trisubstituted stearate lithium salt represented by Formula 1a below:

(Formula 1a)

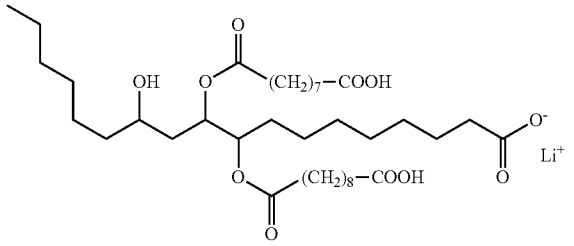

Examples 1 to 7 and Comparative Examples 1 to 2

Grease Preparation

Grease compositions were prepared using ingredients and composition ratios summarized in the list and Table 1 below. In addition, properties of each of the prepared grease compositions were measured according to methods summarized in Table 2 below. Results are summarized in Table 3 below. The ingredients used in the preparation of the grease included the following (i-v):

[Used Ingredients]

(1) Base oil: PAO synthetic base oil having kinematic viscosity of 65 cSt at 40° C.

(2) Thickener: (a) 12-hydroxystearate lithium salt as a conventional lithium-based thickener; or (b) Thickener synthesized according to Preparation Example.

(3) Viscosity regulator: VL1200H available from Lubrizol, as hybrid olefin ester copolymer having viscosity of 800 cSt at room temperature (4) Oil separation regulator: 7460 available from Lubrizol as styrene-ethylene/propylene block copolymer or 7306 available from Lubrizol as styrene-isoprene copolymer (5) General additives: General grease additives such as amine phosphate antioxidant available from ADEKA and Ca-sulfonate corrosion inhibitor available from Vanderbilt Minerals, LLC.

TABLE 1

Grease Compositions

| Ingredients (% by weight) | | Examples 1 | 2 | 3 | 4 | 5 | Comparative Examples 1 | 2 | 3 | 4 | 5 | 6 |
|---|---|---|---|---|---|---|---|---|---|---|---|---|
| Base oil | PAO | 78 | 80 | 77 | 76 | 77.5 | 78 | 80 | 79 | 78 | 80 | 80 |
| Thickener | Li-(a) | — | — | — | — | — | 16 | 18 | 16 | — | — | — |
| | Li-(b) | 16 | 16 | 15 | 14 | 17 | — | — | — | 17 | 17 | 18 |
| Viscosity regulator | | 3 | 1 | 5 | 7 | 3 | 3 | — | 3 | 3 | — | — |
| Oil separation regulator | | 1 | 1 | 1 | 1 | 0.5 | 1 | — | — | — | 1 | — |
| General additives | | 2 | 2 | 2 | 2 | 2 | 2 | 2 | 2 | 2 | 2 | 2 |

TABLE 2

Property Measurement Methodology

| Evaluated item | Evaluated standard | Evaluated condition |
|---|---|---|
| Shear viscosity | DIN 51810 | [Oscillation Test] Deflection angle: 400 mrad, 700 mrad Frequency 0.5 Hz Temperature: 25[ Gap: 0.2 mm |
| Low-temperature torque | ASTM D1478 | Low-temperature characteristics were evaluated by measuring torque value of bearing outer race when bearing inner race was rotated at 1 rpm, −40° C. |
| Oil separation degree | ASTM D1472 | Change in weight was measured after standing at 100° C. for 24 hr |
| Unit operability | ES97405-03 | Time taken to pass 2 cycles was measured rotating inner race at 25/−40° C., 10 rpm |

TABLE 3

Property Measurements

| Property evaluation | | Examples 1 | 2 | 3 | 4 | 5 | Comparative Examples 1 | 2 | 3 | 4 | 5 | 6 |
|---|---|---|---|---|---|---|---|---|---|---|---|---|
| Shear viscosity (Pas) | 400 mrad | 13.2 | 16.5 | 14.3 | 13.6 | 15.6 | 13.8 | 26.4 | 15.4 | 12.1 | 19.3 | 24.8 |
| | 700 mrad | 7.47 | 9.21 | 8.1 | 7.9 | 9.76 | 7.69 | 14.3 | 9.67 | 6.73 | 9.97 | 14.1 |
| Oil separation degree (% by weight) | | 0.2 | 0.3 | 0.2 | 0.4 | 0.4 | 1.8 | 2.8 | 2.8 | 1.6 | 0.4 | 1.8 |
| Low-temperature torque (gfcm) | Startup[1)] | 732 | 1035 | 839 | 821 | 1021 | 811 | 2234 | 979 | 671 | 1265 | 2107 |
| | rotation[2)] | 235 | 437 | 410 | 397 | 421 | 374 | 1053 | 401 | 221 | 569 | 953 |
| Unit operability | | OK | OK | OK | OK | OK | OK | OK | OK | OK | OK | OK |

[1)]Startup: Bearing evaluation was started and torque value was measured at time point of 10 s.

[2)]Rotation: Average torque value after rotating for 60 minutes

As shown in Table 3, it can be confirmed that the grease compositions according to Examples 1 to 5 include the ester-based viscosity regulator and the styrene-based oil separation regulator, which have a viscosity of 800 cSt at room temperature, along with the 9,10,12-trisubstituted stearate lithium salt as a thickener, and thus, low-temperature torque, and shear viscosity and oil separation degree which denote component operability at low temperature remain low. On the other hand, the grease compositions of Comparative Examples 1 to 3 include 12-hydroxystearate lithium salt as a thickener, thereby exhibiting high values of 1.8 to 2.8% by weight, compared to values of 0.2 to 0.4% by weight in the grease compositions according to Examples 1 to 5, in 100° C. oil separation degree evaluation. In addition, it can be confirmed that the grease compositions according to Comparative Examples 4 to 6 include the 9,10,12-trisubstituted stearate lithium salt as a thickener, but do not include the viscosity regulator and/or the oil separation regulator, and thus, low temperature torque, shear viscosity and oil separation degree thereof are not satisfied, compared to the examples.

According to the experimental results of the examples, it can be known that the 9,10,12-trisubstituted stearate lithium salt represented by Formula 1 according to the present disclosure is effective as a thickener of a grease composition including a PAO synthetic base oil. In addition, the 9,10,12-trisubstituted stearate lithium salt represented by Formula 1 along with the ester-based viscosity regulator having a specific viscosity range and the styrene-based oil separation regulator is included in a grease composition, and thus, thermal stability at high temperature and operability at low temperature may be simultaneously improved.

The thickener according to the present disclosure along with the synthetic polyalphaolefin (PAO) base oil is included in a grease composition, thereby simultaneously enhancing stability at high temperature and operability at low temperature.

The styrene-based copolymer as an oil separation regulator is additionally included in the grease composition according to the present disclosure, and thus, oil separation characteristics at high temperature and operability at low temperature are further enhanced.

The ester-based viscosity regulator having a specific viscosity is additionally included in the grease composition according to the present disclosure, and thus, low-temperature operability may be further enhanced.

The present disclosure has been described in detail with reference to various forms thereof. However, it will be appreciated by those skilled in the art that changes may be made in the various forms without departing from the principles and spirit of the present disclosure, the scope of which is defined in the appended claims and their equivalents.

What is claimed is:

1. A lithium-based thickener represented by Formula 1 below:

(Formula 1)

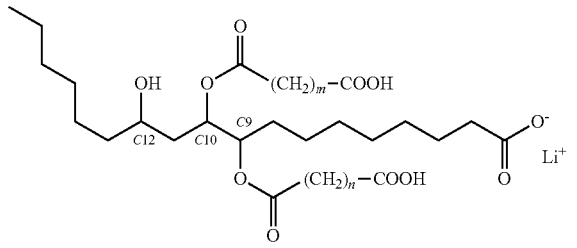

wherein m and n are the same or different and are integers of 5 to 20.

2. The lithium-based thickener according to claim 1, wherein m and n are the same or different and are integers of 7 or 8.

3. A grease composition comprising a synthetic polyalphaolefin (PAO) base oil, a lithium-based thickener and grease additives, wherein the lithium-based thickener is a 9,10,12-trisubstituted stearate lithium salt represented by Formula 1 below:

(Formula 1)

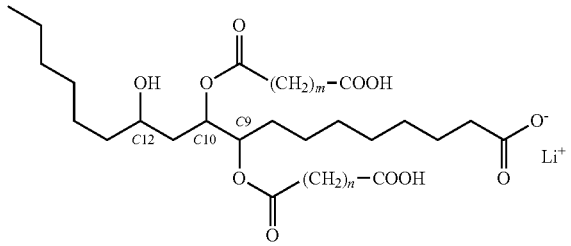

wherein m and n are the same or different and are integers of 5 to 20.

4. The grease composition according to claim 3, wherein the grease composition comprises:

70 to 85% by weight of the synthetic polyalphaolefin (PAO) base oil;

10 to 20% by weight of the lithium-based thickener; and 0.1 to 10% by weight of the additives.

5. The grease composition according to claim 3, wherein an ester-based viscosity regulator having a viscosity of 500 to 1000 cSt is included as an additive.

6. The grease composition according to claim 5, wherein the ester-based viscosity regulator is included in a content range of 1 to 7% by weight based on a total weight of the grease composition.

7. The grease composition according to claim 3, wherein one or more styrene-based oil separation regulators selected from the group consisting of a styrene-ethylene/propylene block copolymer and a styrene-isoprene copolymer are included as additives.

8. The grease composition according to claim 6, wherein the styrene-based oil separation regulator is included in a content range of 0.5 to 3% by weight based on a total weight of the grease composition.

* * * * *